US006138767A

United States Patent [19]

La Vergne

[11] Patent Number: 6,138,767

[45] Date of Patent: Oct. 31, 2000

[54] THROUGH THE PUMP FOAM SYSTEM

[75] Inventor: Eric La Vergne, Groves, Tex.

[73] Assignee: Williams Fire & Hazard Control, Inc., Vidor, Tex.

[21] Appl. No.: 09/096,798

[22] Filed: Jun. 12, 1998

Related U.S. Application Data

[60] Provisional application No. 60/049,537, Jun. 13, 1997.

[51] Int. Cl.[7] ..... A62C 35/02

[52] U.S. Cl. ..... 169/15; 169/44; 239/318

[58] Field of Search ..... 169/14, 15, 44; 239/310, 318; 137/488, 895

[56] References Cited

U.S. PATENT DOCUMENTS

| | | | |
|---|---|---|---|
| Re. 19,965 | 5/1936 | Schroder et al. | 169/15 X |
| 1,591,401 | 7/1926 | Palmer | 169/15 X |
| 2,003,184 | 5/1935 | Friedrich | 169/15 X |
| 2,752,934 | 7/1956 | Badberg | 169/14 X |
| 3,234,962 | 2/1966 | Williamson | 169/14 X |
| 4,181,469 | 1/1980 | Dion-Biro | 169/14 X |

*Primary Examiner*—Lesley D. Morris
*Attorney, Agent, or Firm*—Sue Z. Shaper; Felsman, Bradley, Vaden, Gunter & Dillon, L.L.P.

[57] ABSTRACT

Apparatus and method for in-line inducting additive into a fire fighting flow line before the pump, including automatic regulating of water flow.

13 Claims, 4 Drawing Sheets

THROUGH THE PUMP FOAM SYSTEM

This invention is entitled to the benefit of an earlier filing date based on U.S. Provisional Application Ser. No. 60/049,537, filed on Jun. 13, 1997.

BACKGROUND OF THE INVENTION

1. Field of Invention

This invention relates to fluid additive supply systems for fire fighting equipment, and in particular to systems for adding foam concentrate into a water stream used for fire fighting operations.

2. Description of Related Art

Fire fighting mechanisms typically include a source of water (the primary fire fighting fluid) connected to a water pump that supplies water via a conduit (fire hose) to a discharge device (hand held nozzle, monitor, sprinkler system, foam chambers, etc.).

It is often desirable to have a mechanism that can supply an additive, such as foam concentrate, into the water stream. Foam is useful in extinguishing certain types or classes of fires, particularly flammable liquid fires. The additive supply mechanisms may have a metering device that allows the introduction certain percentages of foam to water, termed proportioning, to be varied (i.e. 1%, 3%, 6% foam to water proportioning are the most common).

There are numerous systems on the market that supply additives into water streams. The majority of these systems are in fixed installations or permanently mounted in fire fighting apparatus such as a fire truck. Such apparatus for foam proportioning are discussed and disclosed, for instance, in U.S. Pat. No. 4,436,487. Many of these systems require the use of foam concentrate additive pumps for forced injection. These pumps may be, for example, either positive displacement or centrifugal type. Such systems designed for foam proportioning are complicated and very expensive.

Alternatively, the basic design and principle of a venturi device can be used to "induct" or "educt" foam concentrate into the primary water stream Venturi mechanisms use primary liquid flow to create a pressure drop across an orifice. The pressure drop forms a partial vacuum into which fluid or gases will flow if permitted. Additives supplied in the vicinity of the venturi mechanism will be pulled into the partial vacuum created.

A close relative of the present invention is termed an "around the pump" foam system. These systems involve the use of jet pumps and/or eductors together with a pump. The "around the pump" foam system is setup as follows (FIG. 1). The fire fighting apparatus connects a pressurized water source such as from a fire hydrant 1 to the suction inlet side 6 of the water pump 2 via a water conduit line 7. A further water conduit line 8 attaches to the discharge outlet side of the water pump 2 and connects to a deployed downstream fire fighting fluid delivery device such as for example a hand held nozzle 3, fixed nozzle termed a "monitor", or a sprinkler system. An auxiliary conduit 10 from the discharge outlet side 9 of the water pump is connected to a jet pump and/or eductor 4. The discharge conduit 11 from the jet pump and/or eductor 4 is attached to an auxiliary connection on the suction inlet side of the water pump 12. Once water flow is established, the auxiliary discharge conduit 10 supplies water to the inlet of the jet pump and/or eductor 4. The water passes through a pressure drop area. The additive 5 is drawn from a suction port inlet 13 that is connected to the device in the low pressure zone that is created by this pressure drop. The additive is entrained by the operating water stream of the jet pump and/or eductor. The entrained foam concentrate mixing together with the jet pump and/or eductor operating water stream is then injected into the auxiliary connection 12 on the suction side of the pump 2. The total solution than passes through the water pump where a pressure increase is effected. Once adequately pressurized, the water/additive solution is then directed into the deployed downstream fire fighting fluid delivery device 3. The "around the pump" foam system can either be installed as a fixed installation on the water pump apparatus or can be deployed portably.

Some inherent problems associated with the "around the pump" foam system are as follows. The ability for the system to operate is based on the performance of the jet pump/eductor. The jet pump/eductor must have the energy (discharge head pressure) to inject the entrained foam into the pressurized system of the water pump. The available energy is based on the style of the jet pump/eductor and the operating water pressure supplied to the inlet of the jet pump/eductor, the amount of additive picked up, and the discharge velocity of the homogenous fluid mixture(i.e. operating water and additive). As a rule jet pumps inducting a high relative percent of additive fluid have discharge capabilities of approximately 30% of inlet pressure. Full in-line eductors inducing a low relative percent of additive have discharge capabilities of approximately 65% of inlet pressure. In the relevant fire fighting systems of the present invention, additive pick up is normally approximately 1.8–15 gpm (gallons per minute) (based on different eductor models with flow capabilities ranging from 30–250 gpm at 6% proportioning).

Once the pressure on the inlet side of the water pump exceeds the discharge head pressure, the proportioning of foam will either decrease or totally cease, usually the latter. Thus, if the supply water conduit to the pump system inlet has an inlet pressure exceeding the discharge capabilities of the jet pump/eductor, as is often the case, a manual control valve will need to be adjusted, such valve is installed between the water supply and the inlet side of the water pump. The port through the valve will be reduced to adjust the water pressure at the pump inlet so as to not exceed the discharge head capabilities of the jet pump/eductor.

Inlet water pump pressure variation is usually caused by the increase or decrease in total volume through the water pump. Once the manual control valve is adjusted for the determined flow, any deviation of flow will cause a variation in pressure. Many times this variation is enough to exceed the capabilities of the jet pump/eductor and causes system failure. Volume variations are normally due to the opening and closing of the downstream water stream delivery devices. Thus, the water pump operator must constantly monitor the discharge water volume and adjust the manual control valve accordingly. Without this constant adjustment the inlet water pressure to the pump will either be in excess of the jet pump system, or will not have adequate volume to supply the discharge requirements, resulting in cavitation.

Another deficiency in the current "around the pump" foam system relates to fluctuation in the percentage of additive concentrate. The fluctuation is due to changing water volumes created by the opening and closing of the downstream fluid delivery devices. Once the desired amount of concentrate is selected, the volume of concentrate added is fixed at the optimum proportioning level. If the volume of water passing through the water pump changes and the amount of additive remains the same than the percent (it additive will vary immensely. An example of this is as follows.

Example

A fire apparatus is set up as described earlier utilizing "around the pump" technology. Two hand-lines are deployed from the apparatus each flowing 97 gpm water and 3 gpm foam concentrate for a total of 200 gpm water/foam solution. The most common proportioning of foam concentrate added to a water stream delivery device is 3%. If one of the lines is truncated without making the proper adjustments to the jet pump/eductor then the single hand line left in operation will now be proportioning water/foam solution at the rate of 6%. The proportion of foam to water may be critical to optimum performance of the foam with respect to the peculiarities of the fire being fought. In order to maintain an "around the pump" foam system performing adequately the operator must constantly monitor the volumes and pressures of all the liquids involved with the system.

SUMMARY OF THE INVENTION

The invention disclosed herein comprises both apparatus and method dedicated to the regulated supply of fire fighting additive, particularly foam concentrate, to a fire fighting water stream. A system for the addition of foam concentrate comprises a pressurized water supply source, an in-line venturi/modulating valve assembly, an additive source, an in-line fluid pump drive and one or more terminal foam/water delivery devices. Together these form a "through the pump foam system" or "TTP foam system."

In a preferred embodiment, the "in-line venturi/modulating valve assembly" of the subject invention comprises a flow regulation valve, a sensor of a pilot valve for measuring an indicia of pressure downstream of the flow modulation valve, and at least one venturi mechanism for the induction of foam concentrate. In a preferred embodiment, the sensor measures water pressure and the pilot valve is biased to reflect venturi mechanism discharge pressure. In a preferred embodiment, a sensor associated with a pilot valve governing the flow modulation valve mounted proximate to an in-line venturi mechanism senses downstream line pressure and adjusts the fluid backpressure acting on the water stream such that proportioning is to be maintained at desired levels despite changes in line pressure.

The venturi/modulating valve assembly uses the motive force of the pressurized water source for foam eduction and is placed in the system upstream of the pump drive used to increase pressure after flow through the in-line venturi/modulating valve assembly. Fluid line pressure lost in passage through the "venturi/modulating valve assembly" is increased by the subsequent fluid pump which then transmits the fluid to a downstream terminal fire fighting solution delivery device. In such a manner recirculating foam additive/water mixture through the pump in the manner of "around the pump" systems is avoided.

In an alternative embodiment, the "in-line venturi/modulating valve assembly" includes at least two venturi mechanisms, one suitable for high flow and one suitable for lower flow. Diversion of the motive flow to the high or low flow venturi is made through a diversion valve.

The invention combines the simplicity of venturi foam additive eduction with the higher performance capabilities of strictly pump driven systems but offers important advantages over the existing "around the pump" combination. The "through the pump foam system" described herein allows for simple and consistent foam proportioning without the constant monitoring of pressure and flows.

The invention also comprises a method for producing fire fighting foam that includes supplying a water stream from a pressurized water source through fluid conduit, modulating the water stream pressure through the use of a modulation valve, inducting fire fighting additive into the modulated water stream through the use of a venturi mechanism, pressurizing the foam/water stream and discharging the pressurized water additive mixture through a terminal fire fighting delivery device.

BRIEF DESCRIPTION OF THE DRAWINGS

A better understanding of this invention can be obtained when the following detailed description of the preferred embodiments is considered in conjunction with the following drawings.

DETAILED DESCRIPTION OF THE PREFERRED EMBODIMENTS

Figure 1:
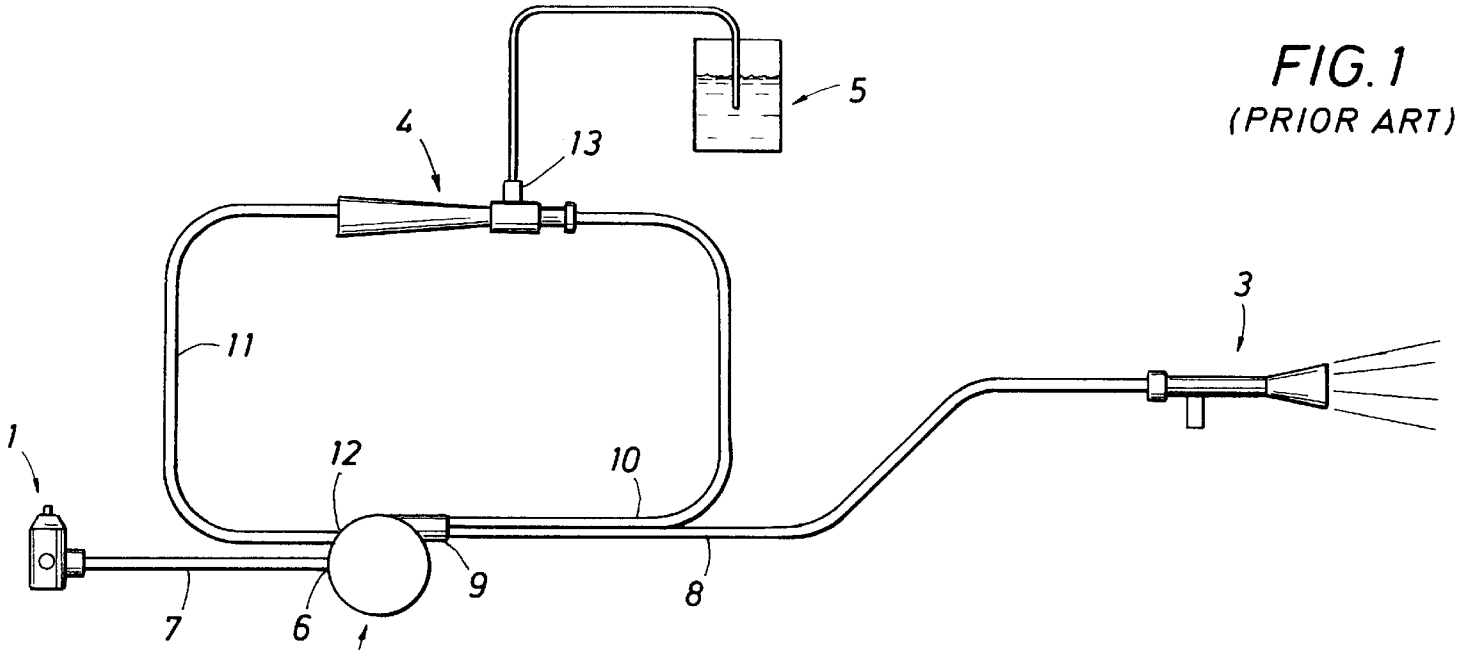
FIG. 1 (PRIOR ART)
FIG. 1 illustrates the common setup of the prior art "around the pump" foam system.
Figure 2:
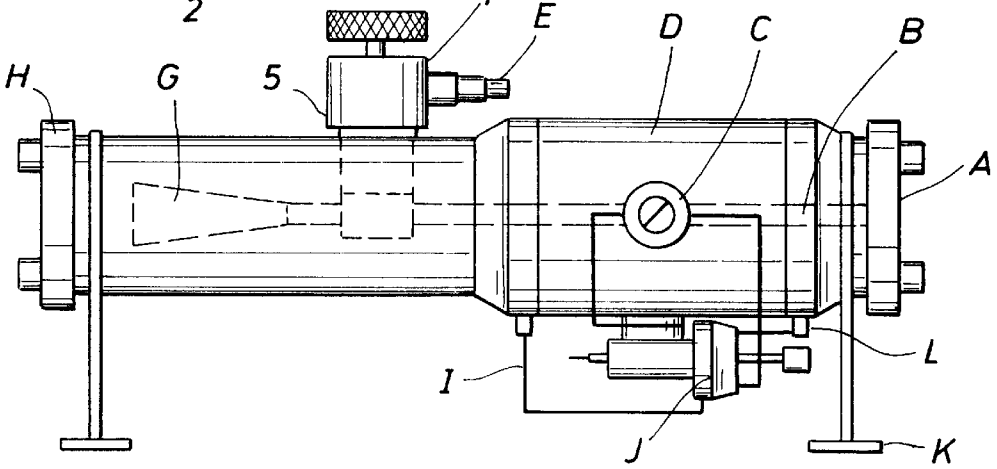
FIG. 2 illustrates in schematic cross-section an embodiment of the in-line "venturi/modulating valve assembly" of the subject invention comprising an in-line jet pump together with a flow modulation valve.
Figure 3:
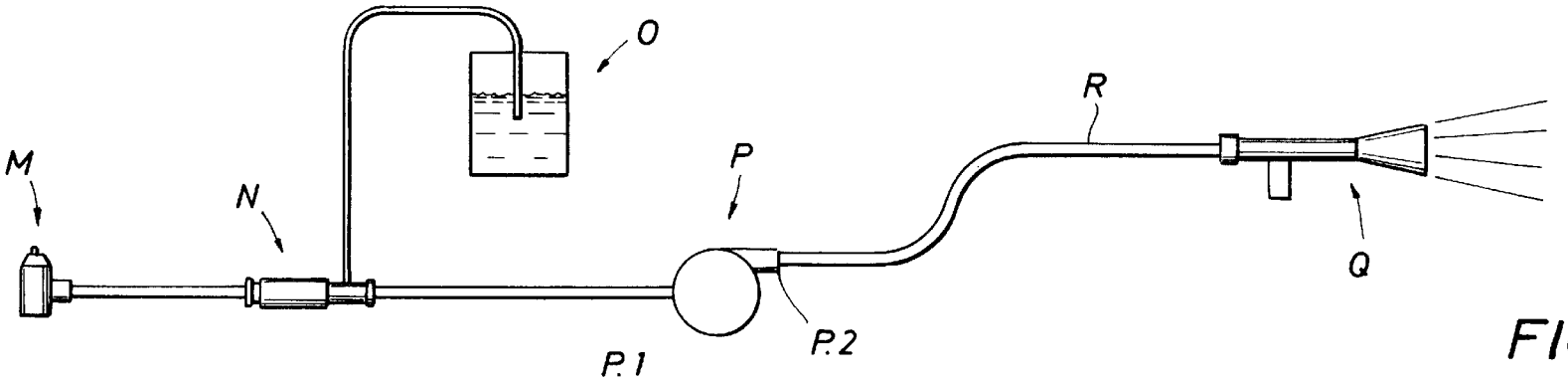
FIG. 3 illustrates a preferred embodiment of the present "through the pump foam system".
Figure 5:
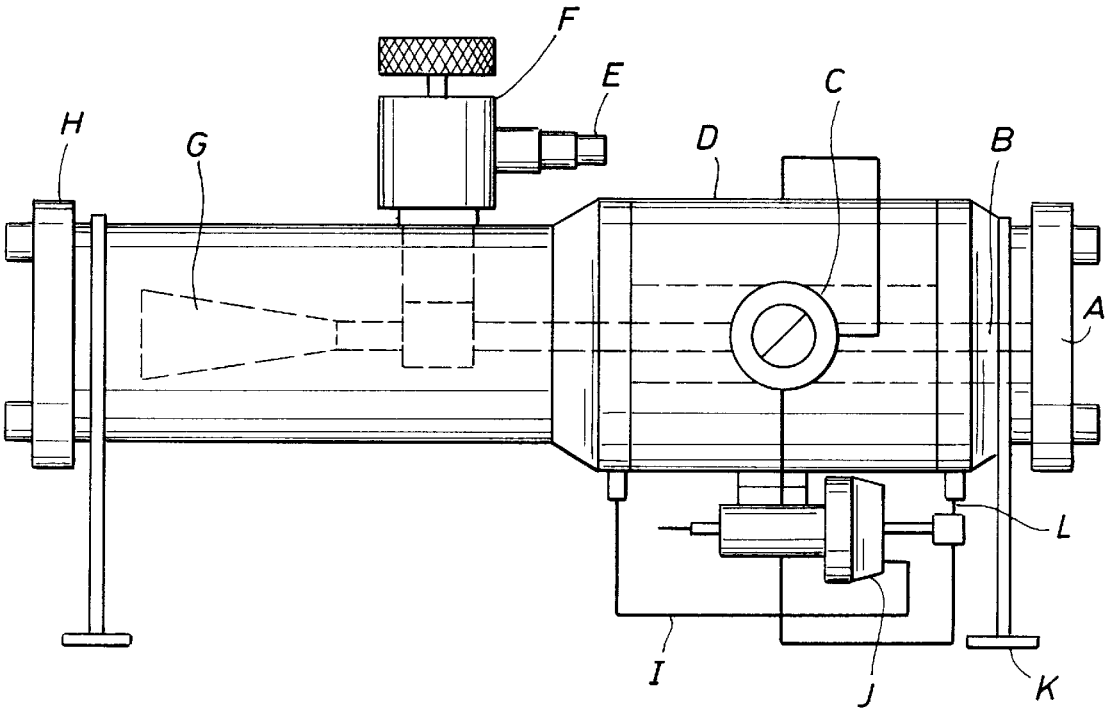
FIG. 5 illustrates in schematic cross-section the "venturi/modulating valve assembly" operating in a low flow environment.
Figure 6:
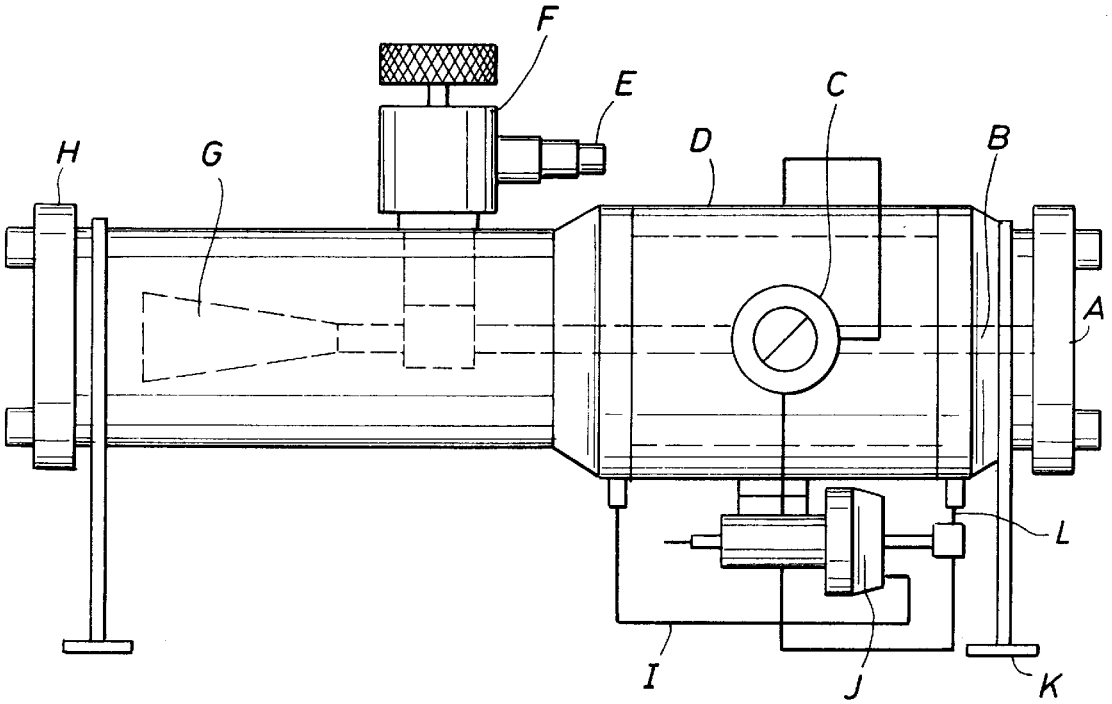
FIG. 6 illustrates in schematic cross-section the "venturi/modulating valve assembly" operating in a high flow environment.

In a normal operations illustrated in FIG. 3 the "venturi/modulating valve assembly N", also termed "TTP foam assembly", is installed between water supply M and the inlet side P.1 of a water pump P. As the supply water passes through the "venturi/modulating valve assembly N" the water supply pressure is automatically adjusted to meet preset pressure requirements. These preset pressures are designed to be below the maximum discharge head capabilities of the jet pump G. See also FIG. 2 The jet pump G is located within the "venturi/modulating valve assembly N". A small volume of water (high pressure) is bypassed through the modulating valve providing adequate pressure and water volumes to operate the jet pump G. Several sensing lines monitor the pressures on the inlet L and down stream side I of the water modulation valve. As the demand for water supply is increased, the sensing lines will detect the decrease of water supply pressure on the down stream side of the "venturi/modulating valve assembly". This decrease in pressure triggers the modulation valve D on the "venturi/modulating valve assembly N" to open allowing for a higher volume of water to enter the pump until the pressure of the downstream water supply matches the preset pressure of the "venturi/modulating valve assembly" as shown on FIG. 6. As the demand for water supply is decreased the sensing lines will detect the increase of water supply pressure on the down stream side of the "venturi/modulating valve assembly". The increase in pressure triggers the modulation valve on the "venturi/modulating valve assembly" to close and decrease the amount of water entering the pump until the pressure of the down stream water supply matches the preset pressure of the "venturi/modulating valve assembly" as shown on FIG. 5. This modulation occurs automatically to assure that the inlet pressure of the water pump will never exceed the discharge head capabilities of the "venturi/modulating valve assembly".

Figure 4:
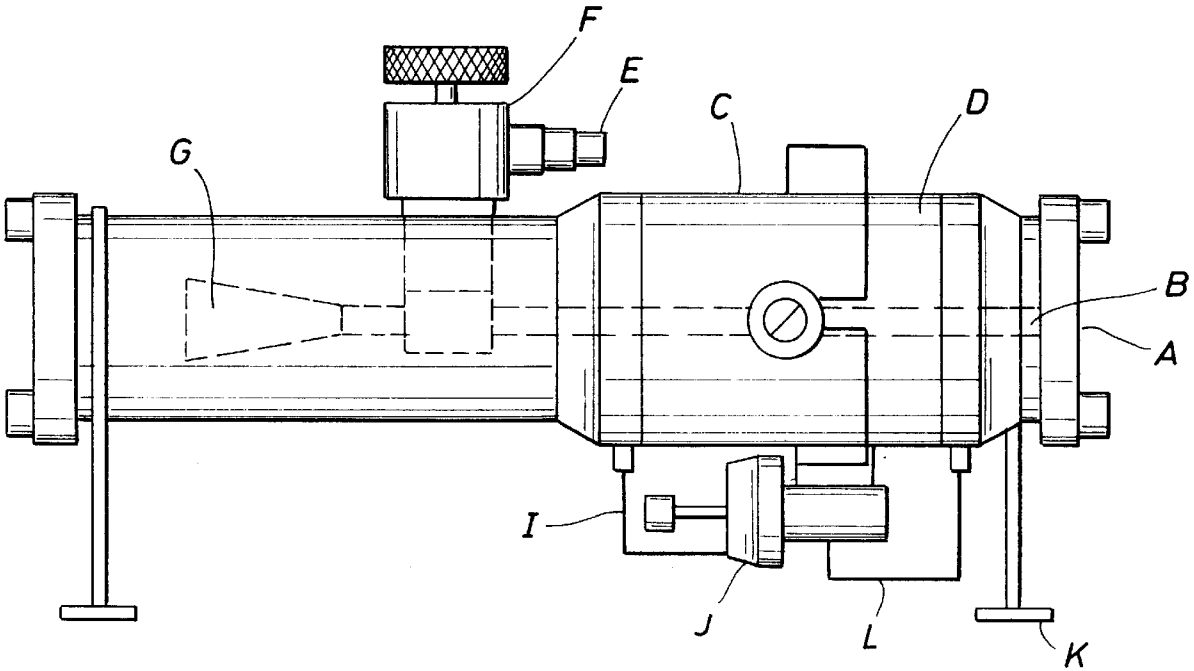
FIG. 4 illustrates in schematic cross-section the "venturi/modulating valve assembly" in the "off" position.

The unit control valve C of FIG. 2 allows the operator to select the mode of operation of the "venturi/modulating valve assembly". In automatic mode the unit will perform as described above, adjusting water pressures as required. In the open mode the modulation valve will open completely allowing for maximum flow through the unit without any modulation. In the closed mode shown in FIG. 4, the modulation valve closes completely preventing water from passing through the "venturi/modulating valve assembly" (the jet pump or eductor motive flow will still be allowed to pass through the system in the closed mode).

As the water from the high pressure side A enters the inlet B of the jet pump nozzle G, the jet pump nozzle converts the pressure of the jet pump operating water into a high velocity stream. As the high velocity stream enters the low pressure area of the jet pump, the low pressure area allows for a liquid additive to be educted into the low pressure area. The jet pump operating water entrains the water additive and the solution flows into the mixing area of the "venturi/modulating valve assembly"

Water additive proportioning can be established by several means as follows:

Method One: Automatic modulation:

Located at the inlet of the additive jet pump it provides for a positive and automatic means of proportioning. Pressure sensing lines are used to monitor pressure drop across an orifice located in the mixing chamber of the "venturi/modulating valve assembly". Based on the differential pressure across the orifice total volumes can be sensed. One of the sensing lines connects directly to an additive modulation valve. The second sensing line is attached to a pressure amplifier. From the pressure amplifier the sensing lines terminates into the additive modulation valve opposite sensing line 1. lines. The additive modulation valve reacts accordingly as the pressure differential across the orifice in the mixing chamber varies. This additive modulation valve at the inlet of the additive jet pump allows for precise automated metering of the correct volumes of additives into "venturi/modulating valve assembly".

Method Two: Variable Metering Valve:

Located at the inlet of the additive jet pump it provides for positive and manual means of proportioning. The variable metering valve utilizes a characterized ball valve to provide additive proportioning over a wide range (0 gpm—maximum jet pump pickup). The variable metering valve is designed with a positive off feature. Once the water flow is established on the system the operator selects the volume of additive to be introduced into the system. The volume of additive is positive and constant and will not vary unless reestablished by the operator.

Method Three: Fixed Orifice:

Location of a fixed orifice at the inlet of the additive jet pump provides for a fixed means of proportioning. This method by far is the simplest of the earlier mentioned methods. It is designed for operations that will be utilizing set water flows with no variances.

Method Four: Remote Jet Pump:

Located away from the inlet of the additive jet pump provides for positive and remote means of proportioning. Remote Jet Pump proportioning utilizes a separate independent jet pump. The independent pump can be located a considerable distance away from the "venturi/modulating valve assembly". Independent jet pump operating water is supplied by an external pressurized source. Proportioning Methods Two and Three can also be used in conjunction with the independent jet pump. A fluid conduit is attached to the discharge side of the independent jet pump. The fluid conduit then terminates at the additive suction side of the "venturi/modulating valve assembly". Since the independent jet pump is truly discharging into a vacuum area, the two jet pumps can be located a great distance apart.

Once the correct volume of additive is introduced into the water stream. the solution enters the mixing chamber of the "venturi/modulating valve assembly". The total solution than passes through a downstream fluid pump where a pressure increase occurs. Once adequately pressurized by the pump. the water/additive solution is then directed into a fire water delivery device.

In a preferred embodiment of the "TTP foam system" of the present invention as shown on FIG. 3, a "venturi/modulating valve assembly" N is installed between a pressurized water supply M and the inlet side P.1 of a fluid pump P. The pressurized water supply is provided for example, either as central line pressure as is supplied by a water hydrant, or pressure created by pumping water from a water supply such as a tank, reservoir, natural water body, etc. As the supply water passes through the "venturi/modulating valve assembly" N the water supply pressure is detected by pressure sensing lines and the water flow passing through the "venturi/modulating valve assembly" N is automatically adjusted via a modulating valve to meet preset pressure requirements. These preset pressures are designed to be below the maximum discharge head capabilities of a jet pump or eductor functioning as the venturi mechanism. A desired volume of additive originating from an additive source O enters via an additive port into the pressure adjusted water stream within the "venturi/modulating valve assembly". The additive together with the water which educted it into the fluid path is discharged into the "venturi/modulating valve assembly" N. The combined solution than passes through a fluid conduit into a downstream fluid pump P where a pressure increase is effected. Pump P can be a standalone pump or can be the pump on a fire truck. The subject invention can enable an ordinary municipal fire truck lacking a foam proportioning system to efficiently educt and apply foam. Placement of a fluid pump in a location downstream from an inline venturi mechanism enables eduction and adequate pressurization without having to recycle foam additive together with water as in the "around the pump" system. Once adequately pressurized by the pump P, the water/additive solution is then directed out of the pump outlet P.2 and passes via fluid conduit R to a terminal fire fighting solution delivery device Q. Terminal fire fighting delivery device Q can be for example one or more of a fire fighting nozzle, fixed monitor, sprinkler system, floating tank rim seal fire protection system, tank foam port, etc.

The "venturi/modulating valve assembly" disclosed herein comprises a combination of an in-line venturi mechanism together with flow pressure detection and regulation of the water passing around the venturi itself such that a desired flow pressure is maintained without the short comings of prior art systems. Without this regulation, increased water pressure such as occurs when a downstream delivery device is terminated, might cause the venturi to cease operation. Conversely, without pressure regulation and modification, decreases in pressure flowing around the venturi such as when terminal delivery devices are opened may either result in hysteresis or undesirable increases in foam proportioning.

In a favored embodiment of the "venturi/modulating valve assembly" of the subject invention, depicted on FIG.

2, pressurized supply water enters "venturi/modulating valve assembly" at water inlet A. A jet pump G comprises the venturi mechanism. The jet pump G of the preferred embodiment is located within the body of the "venturi/modulating valve assembly" as shown on FIG. 2. An example of such a jet pump is Model 2.0JP60 made by Spectrum Manufacturing (P.O. Box 1359, Mauriceville, Tex. 77626). In a most prefered embodiment, the motive stream for operating the jet pump enters jet pump water inlet channel B and is passed through the center of the modulating valve D via a channel B through the modulating valve D. However, it is contemplated that the channel carrying the motive flow for the jet pump could pass through the modulating valve in a peripheral location as well or could be diverted around the modulating valve.

Figure 7:
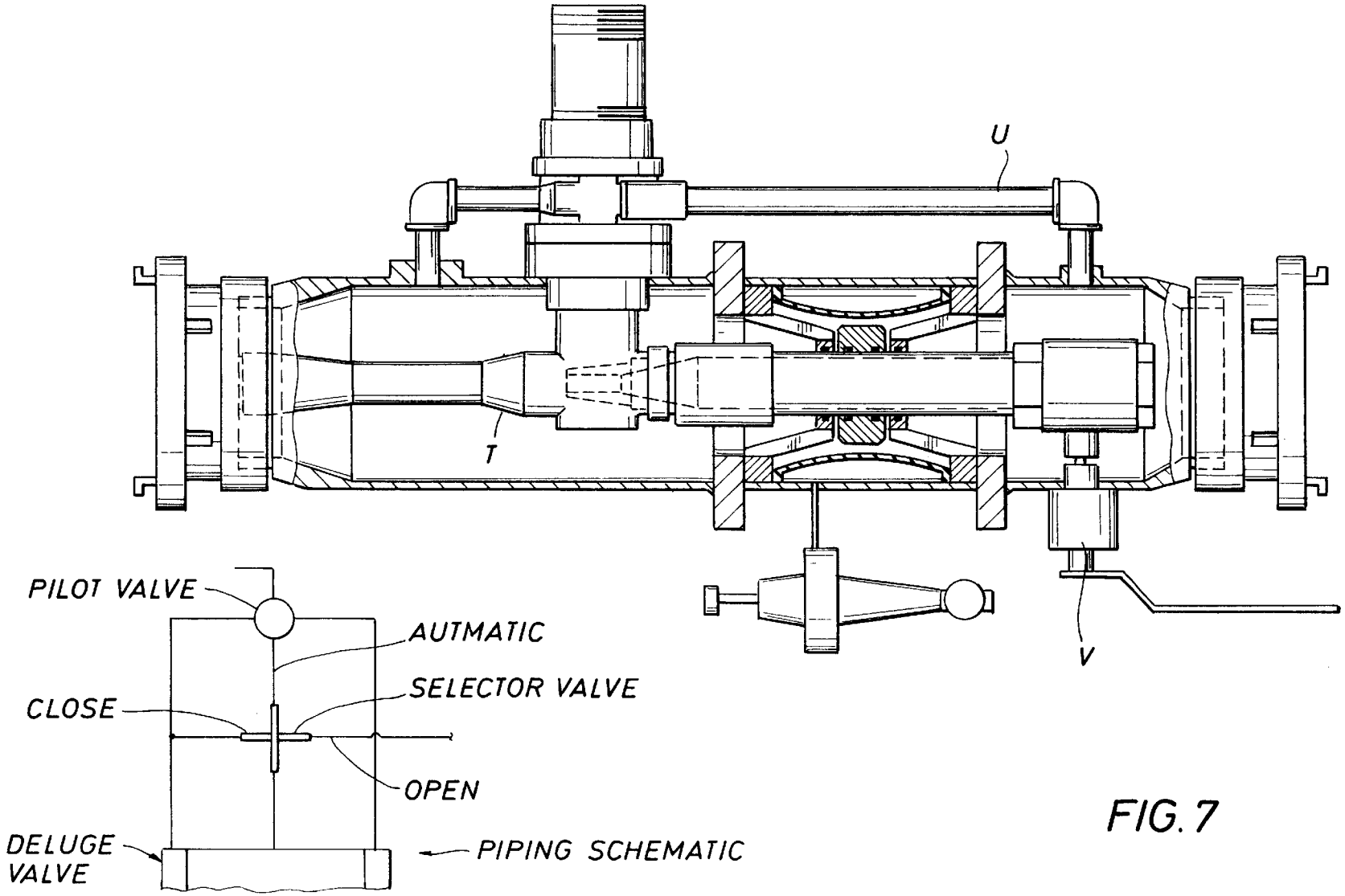
FIG. 7 illustrates in schematic cross-section of an alternate embodiment of the "venturi/modulating valve assembly" further comprising an additional venturi mechanism.

In an alternative embodiment as shown on FIG. 7, the "venturi/modulating valve assembly" further includes a plurality of venturi mechanisms. At least one the venturi mechanism T is suitable for relatively high flow rate while the other venturi mechanism U is suited for lower flow rates. The motive fluid for the venturi mechanisms is diverted by a valve V to either the high or low flow rate venturi as circumstances require.

To return to FIG. 2, one or more pressure sensing lines respective to pressure control or pilot valves monitor the pressure of the main volume of fluid flowing through the venturi assembly. This is the fluid passing around or past the venturi mechanism opening into which the motive fluid of the venturi carrying additive ultimately empties. In a most preferred embodiment, a pressure sensing line is located on the down stream side I of the water modulation valve D. An example of a modulating valve/pressure sensing pilot valve combination able to perform this dual detection and flow regulating function is Pressure Reducing Inbal valve Series 700-R (MIL, P. O. Box 1786, Holon, 58117 Isreal). It is contemplated that any type of pressure sensing device and associated flow regulating device may be used to carry out the purpose of flow and pressure regulation of the main water stream respective to the venturi mechanism.

As the demand for water supply varies, the control valve pressure sensor will detect the variation of water supply pressure on the down stream side I of the modulating valve. This increase or decrease in pressure triggers the modulation valve D on the "venturi/modulating valve assembly", by virtue of the pilot valve J, to open or close allowing for a higher volume of water to flow through the "venturi/modulating valve assembly" and enter the downstream water pump, until the pressure of the downstream water supply matches the preset pressure of the pilot valve associated with the "venturi/modulating valve assembly" shown on FIG. 6. As the demand for water supply settles, the pilot valve will stabilize the modulation of water through the modulating valve. A sensed increase in pressure triggers the modulation valve D on the "venturi/modulating valve assembly" to close and decrease the amount of water entering the assembly until the pressure of the water supply proximate the venturi discharge matches the preset pressure for the pilot valve as shown on FIG. 5. This modulation occurs automatically to assure that the pressure of the water pump will never exceed the discharge head capabilities of the venturi mechanism in the assembly.

The unit control valve C shown on FIG. 2 allows the operator to select the mode of operation of the "venturi/modulating valve assembly". In automatic mode the unit will perform as described above, adjusting water pressures as required. In the open mode the modulation valve to open completely allowing for maximum flow through the unit without any modulation. In the closed mode shown on FIG. 4, the modulation valve closes completely preventing water from passing through the "venturi/modulating valve assembly" (the jet pump or eductor motive flow will still be allowed to pass through the system in the closed mode).

As the water from the high pressure side enters the jet pump motive flow channel B channel at inlet A of the "venturi/modulating valve assembly". the pressure of the jet pump motive fluid is converted into a high velocity stream. As the high velocity stream enters the low pressure area of the jet pump G, the partial vacuum formed allows for a liquid additive to be pulled into the low pressure area. The jet pump motive fluid entrains the water additive and the solution flows out through water/additive discharge H of the "venturi/modulating valve assembly".

It is contemplated that additive proportioning can be established by several alternative means such with either an automatic or variable metering valve, a fixed orifice or together with an additional remote jet pump. In a preferred embodiment, additive passes through inlet E and enters a variable metering valve F, before the additive inlet S of the water additive jet pump 1 which provides for positive and manual means of proportioning. The variable metering valve utilizes a ball valve to provide additive proportioning over a wide range (0 gpm—maximum jet pump pickup). The variable metering valve is designed with a positive off feature. Once the water flow is established on the system the operator selects the volume of additive to be introduced into the system. The volume of additive is positive and constant and will not vary unless reestablished by the operator.

Virtually any type pump able to increase the line pressure after the water/foam solution leaves the "venturi/modulating valve assembly", including for instance displacement pumps or centrifugal type pumps, could be used with the subject invention. In the preferred embodiment, a centrifugal pump is used.

In a typical application, flexible portable fire hose is used to provide the fluid conduit line connecting elements of the invention. However. it is also contemplated that rigid or fixed fluid conduit may be used to provide connections between the source of pressurized water, the "venturi/modulating valve assembly", the downstream pump and the terminal applicator equipment. Either flexible or rigid conduit may be used to permanently install the subject invention in critical locations such as a refinery or tank farm. It is contemplated that connections may be made into the fluid conduit line such as for example to introduce additional additives or to provide for flushing of the line.

FIG. 2 illustrates the operation of unit pilot valve J. Modulated pressure sensing line I senses water pressure downstream of the sleeve or tube valve, not shown. Pilot valve J is preferably spring biased to reflect a preset desired water pressure proximate the discharge of the venturi mechanism. High pressure sensing line L uses the motive force of the entering water to expand the tube or sleeve valve to modulate water flow through the housing. Unit control valve C alternately permits high pressure water to expand the sleeve within the modulating valve or to vent to atmosphere as controlled by pilot valve J.

The foregoing disclosure and description of the invention are illustrative and explanatory thereof, and various changes in the size, shape, and materials, as well as in the details of the illustrated system may be made without departing from the spirit of the invention. The invention is claimed using terminology that depends upon a historic presumptive presentation that recitation of a single element covers one or more, and recitation of two elements covers two or more, and the like.

What is claimed is:

1. An apparatus for the controlled proportioning and application of fire fighting foam comprising:

a pressurized water source;

a venturi/modulating valve assembly in fluid communication with said pressurized source;

an additive source in fluid communication with said venturi/modulating valve assembly;

at least one pump in fluid communication with, in-line with, and downstream from, said venturi/modulating valve assembly;

at least one terminal delivery device downstream from, and in fluid communication with, said pump; and wherein said venturi/modulating valve assembly comprises at least one venturi mechanism, a sensor to monitor an indicia of water pressure upstream of the pump, and a flow regulating valve responsive to said sensor for controlling the pressure of water moving through said assembly.

2. The apparatus of claim 1 wherein the sensor monitors an indicia of water pressure downstream of the flow regulating valve.

3. The apparatus of claim 2 wherein said sensor monitors water pressure.

4. The apparatus of claim 2 wherein said assembly includes a pilot valve biased to reflect venturi mechanism discharge pressure.

5. The apparatus of claim 2 wherein said flow regulating valve includes a tube valve.

6. A venturi/modulating valve assembly comprising:

a housing in fluid communication with a source of fire fighting water and with a pump, the pump upstream of and in fluid communication with a fire fighting fluid discharge device, said housing having at least one venturi mechanism;

a water flow regulating valve; and at least one pilot valve responsive to an indicia of water pressure upstream of the pump and adapted to adjust said water flow regulating valve.

7. The assembly of claim 6 wherein said venturi mechanism includes an inlet proximate a housing water inlet.

8. The assembly of claim 6 wherein said pilot valve utilizes housing inlet pressure to adjust the water flow regulating valve.

9. The apparatus of claim 6 wherein the housing is between the source and the pump and the pilot valve is responsive to an indicia of water pressure downstream of the flow regulating valve.

10. A method for controlled proportioning and application of fire fighting foam comprising:

supplying a first fluid stream from a pressurized water source through at least one fluid conduit, and including to a pump;

pumping said fluid through at least one second conduit to at least one terminal firefighting delivery device;

inducting fire fighting additive and discharging additive into said first fluid stream prior to pumping; and regulating the pressure of said first fluid stream prior to discharging inducted additive based on an indicia of fluid stream pressure prior to the pump.

11. The method of claim 10 further comprising regulating automatically.

12. A method for introducing fire fighting additive into a fire fighting fluid stream comprising:

supplying a fluid stream from a pressurized water source to a housing in fluid communication with said fluid stream and upstream of a pump;

detecting an indicia of pressure of the fluid stream moving through said housing and upstream of the pump;

regulating flow of said fluid stream through said housing in response to said pressure detected; and inducting fluid additive into said housing and discharging additive into the regulated flow.

13. The method of claim 10 further comprising detecting an indicia of fluid pressure in said conduit and regulating automatially in response to said detected indicia.

* * * * *